US005309751A

United States Patent [19]

Ryan

[11] Patent Number: 5,309,751

[45] Date of Patent: May 10, 1994

[54] PORTABLE CRIMPING TOOL

[75] Inventor: Dale R. Ryan, Harrisburg, Pa.

[73] Assignee: The Whitaker Corporation, Wilmington, Del.

[21] Appl. No.: 38,406

[22] Filed: Mar. 29, 1993

[51] Int. Cl.[5] ..... B21J 9/18

[52] U.S. Cl. ..... 72/450; 72/452; 72/453.16; 29/243.56; 29/753

[58] Field of Search ..... 72/407, 410, 450, 452, 72/453.16, 453.18, 453.03; 29/243.56, 751, 753

[56] References Cited

U.S. PATENT DOCUMENTS

| | | | |
|---|---|---|---|
| 2,647,814 | 8/1953 | Chilton | 72/410 |
| 2,766,631 | 10/1956 | Van Sittert | 72/453.16 |
| 2,962,074 | 11/1960 | Dupree et al. | 72/453.16 |
| 4,109,504 | 8/1978 | Rommel | 72/453.03 |
| 4,932,237 | 6/1990 | Hatfield | 72/452 |

FOREIGN PATENT DOCUMENTS

| | | | |
|---|---|---|---|
| 694831 | 9/1964 | Canada | 29/753 |

OTHER PUBLICATIONS

*Instructions for Cam Location Correction on* 2614 *Pneumatic Power Unit* by Dale Ryan; Feb. 24, 1993.
IS 9641; AMP Incorporated, Harrisburg, Pa. 17105.
Sketch of AMP Tool No. 69365.
IS 9659; AMP Incorporated, Harrisburg, Pa. 17105.
CM 5724; pp. 1, 4 and 6 showing AMP Tool No. 46110.

*Primary Examiner*—David Jones
*Attorney, Agent, or Firm*—Robert J. Kapalka

[57] ABSTRACT

A portable crimping tool is disclosed that includes an actuating mechanism that varies the amount of force made available to the crimping dies. A linear actuator having an axis is provided to move a movable die along that axis into crimping engagement with the mating die. The actuating mechanism includes a pair of links pivotally attached to a slide member. A wedge carried by the linear actuator engages a pair of rollers on the links, causing the rollers to move about other rollers attached to the frame, thereby causing the links to move the dies into crimping engagement.

9 Claims, 5 Drawing Sheets

PORTABLE CRIMPING TOOL

The present invention relates to a portable crimping tool of the type operated by a manually actuated power unit and more particularly to a mechanism for selectively providing a mechanical advantage in such a tool.

BACKGROUND OF THE INVENTION

Portable crimping apparatus currently in use in the industry for crimping electrical terminals onto conductors are typically powered by hydraulic or compressed air actuators or electric motors of the type requiring an external power source. One such crimping tool is the AMP Incorporated tool number 46110 which has a linear actuator which uses a combination of air and hydraulic power to provide the necessary crimping forces. This tool is constructed so that the motion of the movable die toward the fixed die is linear thereby providing a superior crimp relative to that produced by the scissors action type tools known in the industry. The linear actuator of this tool supplies about 3600 pounds of force to the piston rod. There is no mechanism for providing an additional mechanical advantage so that the 3600 pounds of force is made available and applied directly to the crimping die during its entire stroke, although such a large force is required for only a small portion of the stroke. Thus, the unit necessarily must be large enough to supply the full 3600 pounds on demand. An example of a scissors action type crimping tool is the AMP Incorporated tool number 314597-1 which utilizes an air cylinder to drive a wedge between a pair of pivoting links that have mating crimping die halves attached to their ends. The forces made available to the crimping dies by this scissors action can be varied somewhat by varying the surface of the wedge. While the degree of such variation is quite limited the linear actuator need not have the capability of delivering the full amount of required force directly to the crimping dies, but instead may deliver a smaller amount with the wedge and links providing the mechanical advantage to make up the difference. Therefore, a smaller linear actuator may be used, although it is still larger than is necessary. Additionally, the scissors action of this tool is not desirable for crimping. Another crimping tool is the AMP Incorporated tool number 69365 which utilizes an air cylinder to drive a wedge against a single pivotable link which, in turn, pushes against a ram having the movable die attached thereto. This arrangement provides about the same degree of flexibility as that of the tool 314597-1 described above, however, it has the disadvantage of being rather clumsy to handle because the axis of the air cylinder is offset from the axis of the crimping dies and therefor requires an additional handle for proper balance. This, of course, adds weight to the tool and makes it more bulky. In all of these cases the force needed to effect the crimp is not linear over the entire length of the stroke of the actuator, resulting in an actuator having a power output equal to or greater than the highest force required during the course of the crimp. What is needed is a linear action crimping tool having the capability to vary its mechanical advantage to correspond with the forces required during the crimping cycle.

SUMMARY OF THE INVENTION

A portable crimping tool is disclosed having a frame and a linear actuator attached thereto. The frame includes a movable member that is movable along an axis. A mating pair of crimping dies are provided, one of which is attached to the frame and the other of which is arranged to slide toward and away from the stationary die, substantially along the axis. A means is associated with the movable member for effecting the sliding movement of the other die, the means providing a mechanical advantage for a portion of the sliding movement of the other die and a different mechanical advantage for a different portion thereof.

DESCRIPTION OF THE PREFERRED EMBODIMENT

Figure 1:
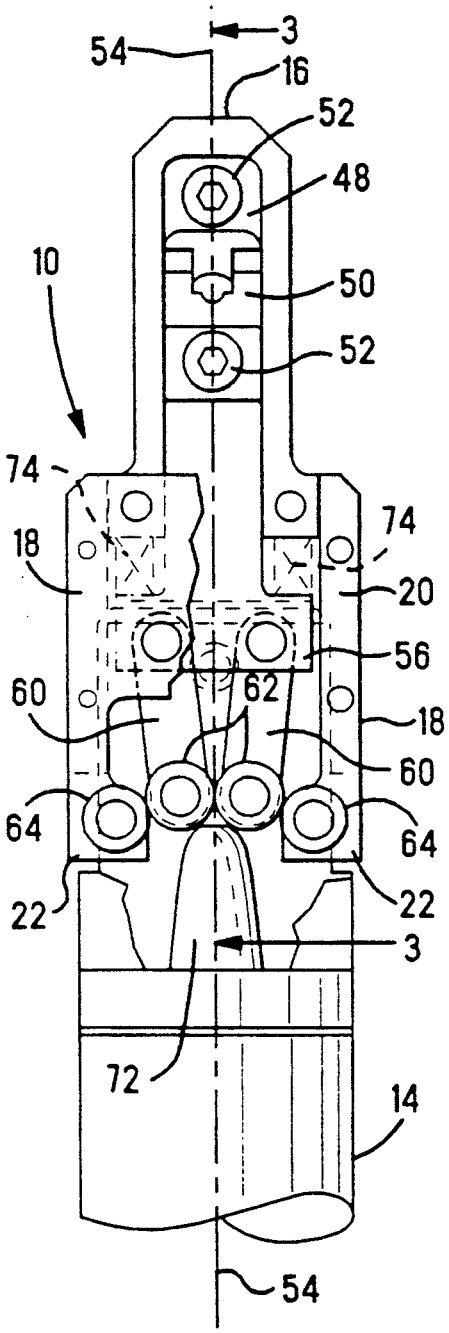
FIG. 1 is a plan view of the present crimping tool incorporating the teachings of the present invention.
Figure 2:
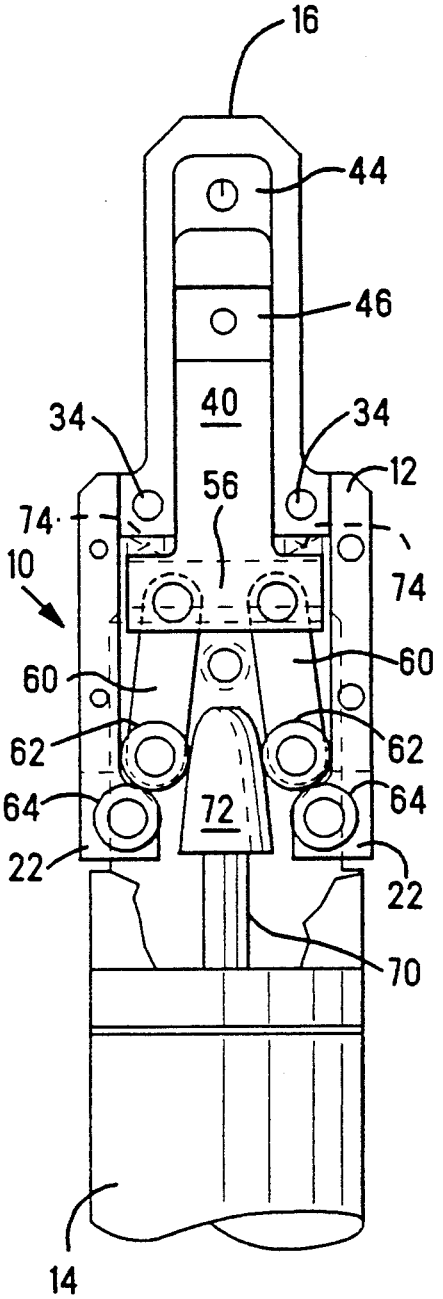
FIG. 2 is a view similar to that of FIG. 1 with the top shell removed and the wedge fully extended.
Figure 3:
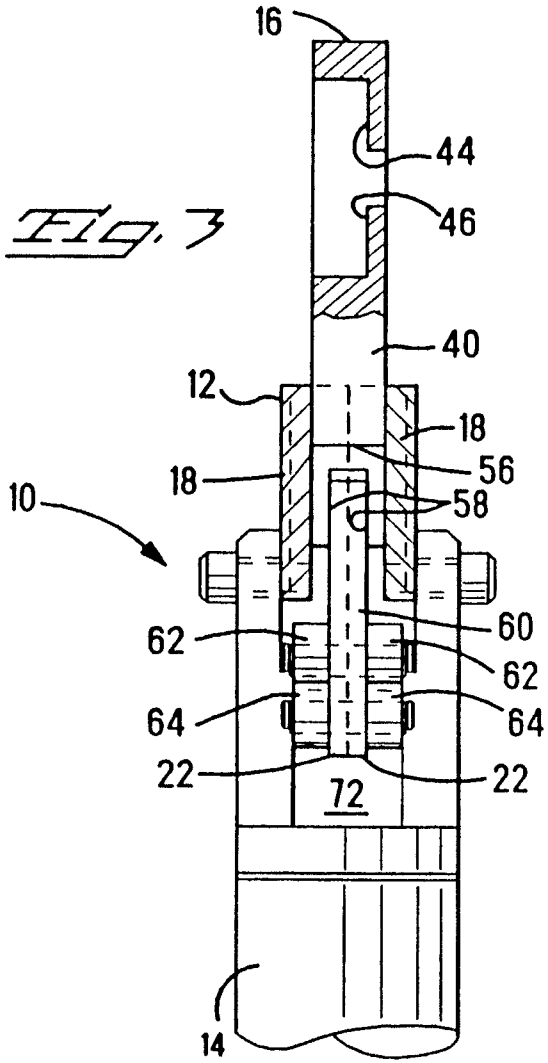
FIG. 3 is a partial cross-sectional view taken along the lines 3—3 of FIG. 1.
Figure 5:
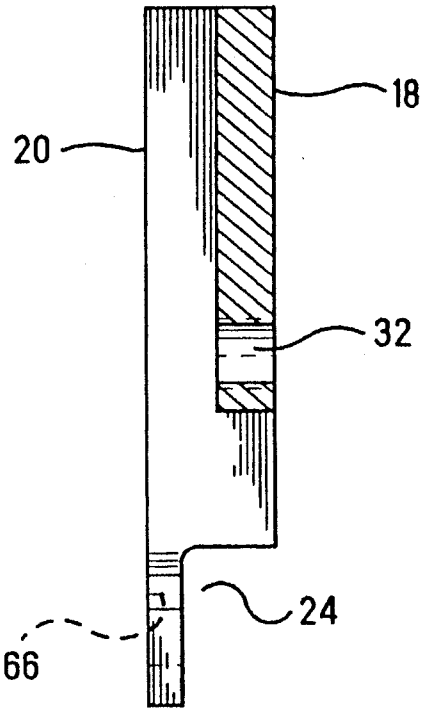
FIG. 5 is a cross-sectional view taken along the lines 5—5 of FIG. 4.
Figure 4:
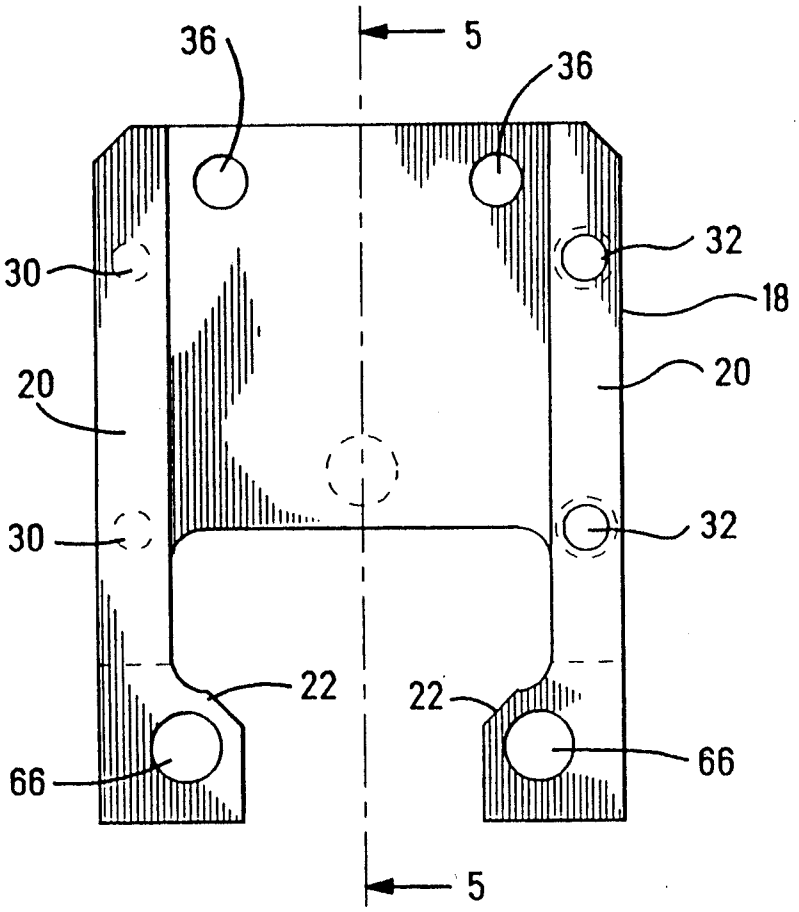
FIG. 4 is a plan view of a shell member of the tool shown in FIG. 1.
Figure 7:
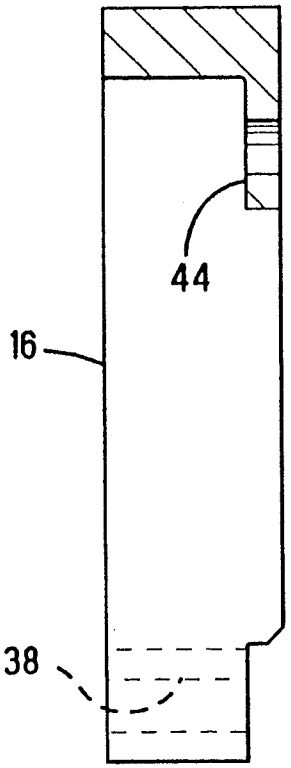
FIG. 7 in a cross-sectional view taken along the lines 7—7 of FIG. 6.
Figure 6:
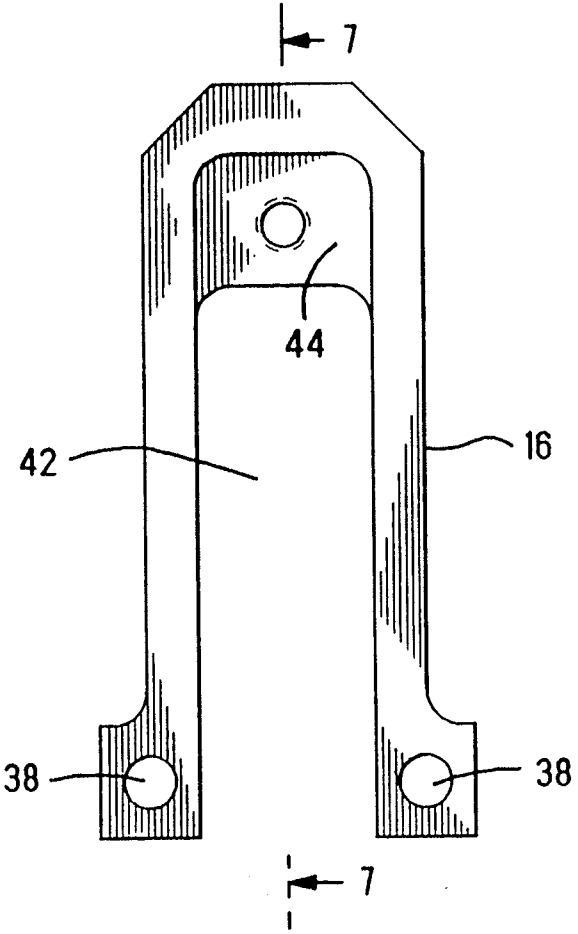
FIG. 6 is a plan view of a die holder of the tool shown in FIG. 1.

There is shown in FIGS. 1, 2, and 3 a portable crimping tool 10 having a frame 12 and a linear actuator 14, an air cylinder in the present example. The frame 12 consists of a die holder 16, shown in FIGS. 6 and 7, and a pair of identical shell members 18, one of which is shown in FIGS. 4 and 5 Each shell member 18 includes a mounting face 20 on each of two raised edges, the raised edges terminating in inwardly turned flanges 22. Note that the mounting face continues along the flanges 22, however, the flanges are offset leaving a cutout 24 in each raised edge. The shell members have a pair of threaded holes 30 in one raised edge and corresponding clearance holes 32 in the other raised edge. When assembled, as best seen in FIG. 3, the two shell members 18 are arranged with their mounting faces 20 in mutual engagement and held in place by means of screw fasteners, not shown, in the holes 30 and 32. The die holder 16 is positioned between the two shell members 18, as shown in FIG. 2, by means of a pair of pins 34 which extend through close fitting holes 36 formed in the shell members and holes 38 formed in the die holder. A slide member 40 is disposed within a cutout 42 formed in the die holder 16 and is sized to slide therein without appreciable lateral play. The die holder 16 includes a die mounting flange 44 at one end of the cutout 42. The slide member 40 includes a die mounting flange 46 on one end thereof opposite to and in alignment with the flange 44. A mating pair of crimping dies are disposed within the cutout 42, one die 48 being attached to the flange 44 and the other die 50 being attached to the flange 46 by means of the screw fasteners 52, as best seen in FIG. 1. The slide member 40 is arranged to move within the cutout 42 along a longitudinal axis 54 in one direction so that the dies 48 and 50 matingly engage for crimping and in the other direction so that the dies are disengaged as shown in FIG. 1. The end 56 of the slide member 40 opposite the flange 46 is bifurcated thereby forming a slot 58 therein. A pair of elongated links 60 are each arranged with one end positioned within the slot 58 and pivotally attached to the end 56 as shown in FIGS. 1, 2, and 3. The other end of each of the links has a pair of rollers 62 journaled for rotation therein, one roller on each side of the link. In the present example each of the links are 1.003 inches from the center of the pivotal attachment to the center of the rollers, and the rollers are 0.444 inch in diameter. Another pair of rollers 64, having the same diameter as the rollers 62, are journaled for rotation in each of a pair of holes 66 formed in the two flanges 22 of each shell member 18 so that there is a roller 64 disposed in each cutout 24. This results in a total of four rollers 62 and four rollers 64, all of which are in alignment and have mutually parallel axes of rotation. The two rollers 62 of one of the links 60 are in rolling engagement with a corresponding two rollers 64 and the two rollers 62 of the other link are in rolling engagement with the other two rollers 64.

The cylinder 14 includes a movable member, or piston rod 70 having a wedge member 72 attached to the end thereof. The cylinder is shown in FIG. 2 with its piston rod and wedge in their extended position and in FIGS. 1 and 3 in their retracted position. A pair of resilient members 74, compression springs in the present example, are arranged between the two shell members 18 so that they urge the slide member 40 toward the cylinder 14 thereby keeping the rollers 62 in operational engagement with the rollers 64.

Figure 9:
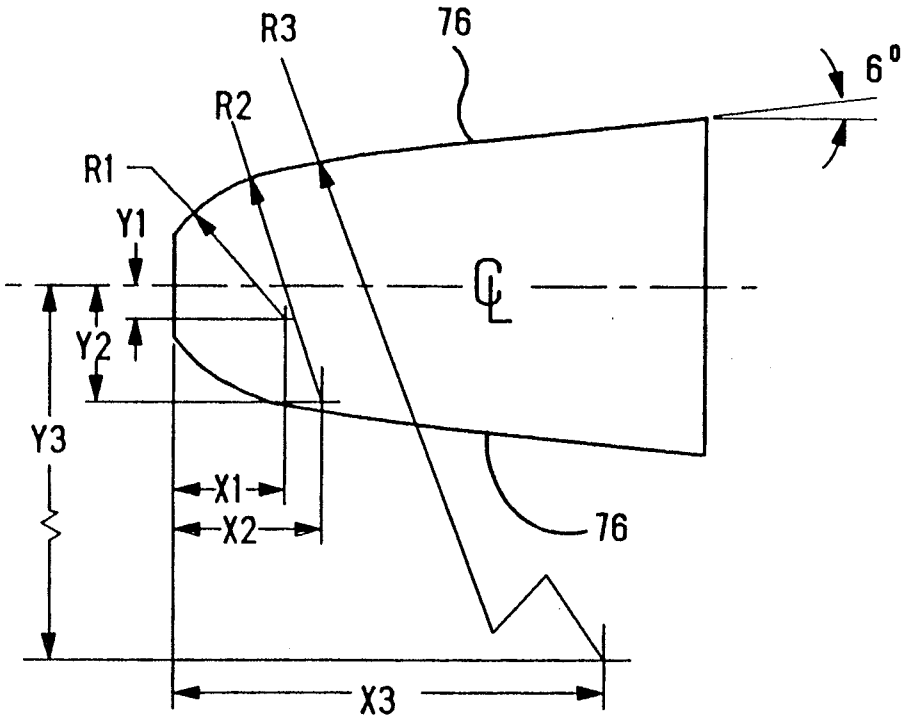
FIG. 9 shows details of the profile of the wedge shown in FIG. 1.

A profile view of the wedge 72 is shown in FIG. 9. The wedge is symmetrical having two opposite camming surfaces 76 that engage the four rollers 62. As is shown, each surface 76 is composed of three radiuses R1, R2, and R3 that intersect smoothly. The radiuses R1, R2, and R3 have the values of 0.2596, 0.4152, and 2.9383 inches respectively, in the present example. The positions of the radiuses X1,Y1; X2,Y2; and X3,Y3 are 0.2138,0.0574; 0.2754,0.2003; and 0.7796,2.6725 inches respectively, in the present example. These values of R, X, and Y have been chosen to cooperate with the geometry of the rollers 62 and 64 and the links 60 to generate a mechanical advantage that changes during the movement of the die 50 toward the die 48. This changing mechanical advantage results in a varying amount of force that is made available at the crimping dies 48 and 50 during the crimping cycle.

In operation, a terminal and associated conductor, not shown, are inserted between the crimping dies 48 and 50 when the tool is in the position as shown in FIG. 1. The cylinder 14 is then actuated so that the piston rod 70 begins to extend, thereby moving the wedge 72 toward the die 48. The camming surfaces 76 push on the rollers 64 causing them to move toward the die 48. As movement continues, the rollers track around the fixed rollers 64 and begin to spread apart, away from the axis 54, and roll along the camming surfaces 76 of the wedge 72. The fixed rollers 64 roll counter to the rollers 62 so that there is no slipping or scuffing of the engaging surfaces thereby minimizing friction. As the rollers 62 move toward the die 48, the links also move pushing the slide member 40 and the attached die 50 toward the die 48. Movement continues until the piston rod 70 and wedge 72 are fully extended as shown in FIG. 2 and the crimp cycle complete. The piston rod 70 and wedge 72 are then retracted, allowing the springs 74 to return the mechanism to its original position shown in FIG. 1.

Figure 8:
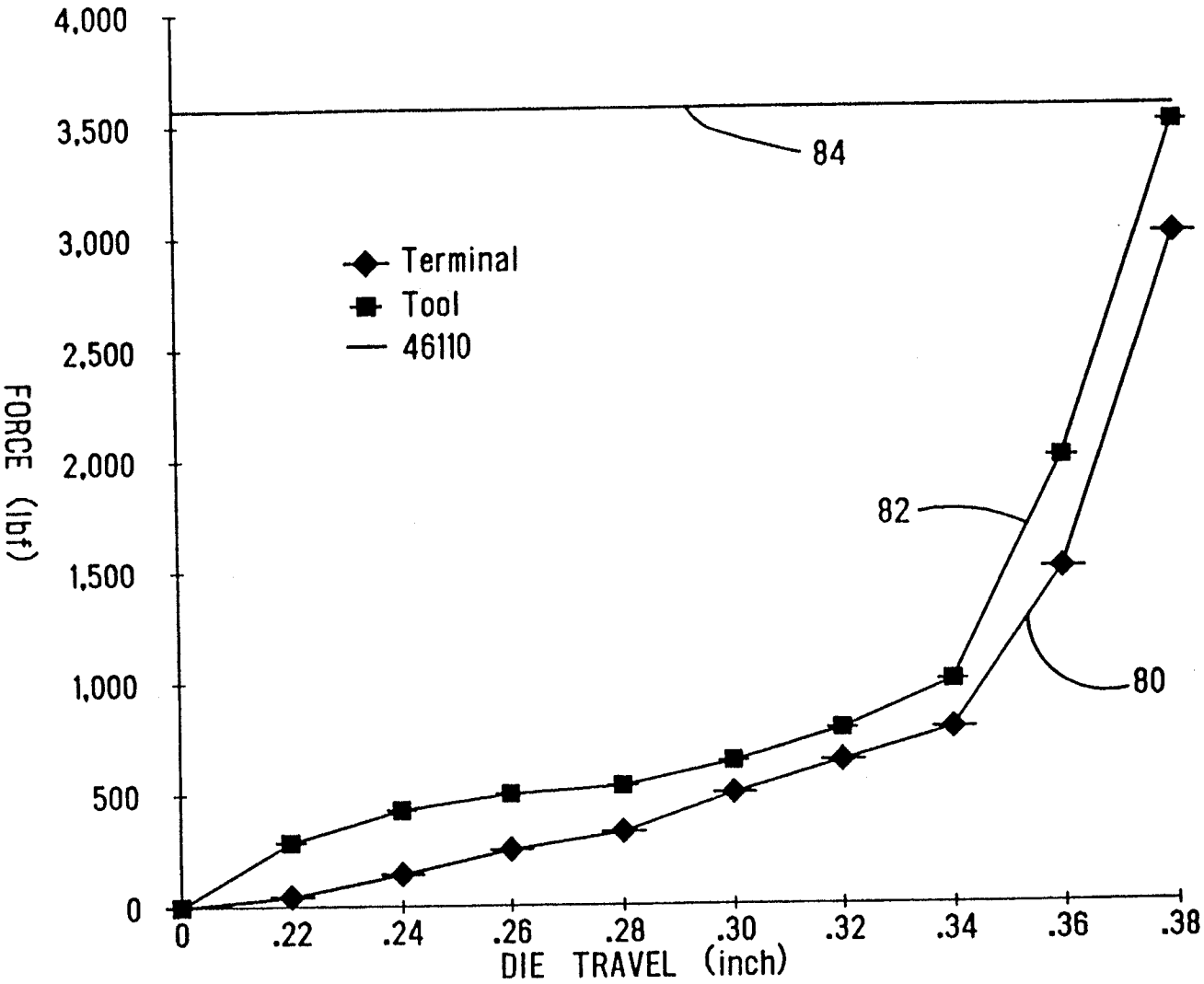
FIG. 8 shows three force graphs.

There is shown in FIG. 8 a graph 80 that represents the force required to crimp a typical terminal onto a typical 16 gage conductor as the movable crimping die moves through the crimping cycle. As is shown, the force is quite small until the die passes the 0.34 inch point, where the force rapidly increases to a maximum of about 3000 pounds at 0.38 inches, the end of the crimp cycle. Ideally, the amount of force made available at the crimping dies would exactly coincide with this force requirement curve thereby achieving complete efficiency. Obviously, such efficiency is difficult to obtain. However, the shape of the camming surfaces 76, the size of the rollers 62 and 64, and the size of the links 60 have been chosen to achieve an efficiency that is superior to that of known prior art crimping tools. The tool of the present example provides a force at the crimping dies as illustrated by the curve 82 in FIG. 8. This provided force is the maximum force made available at the crimping dies for the particular portion of the crimping cycle indicated by die travel along the X axis. Note that the force made available is always greater than the force required for every portion of the crimp cycle by an amount less than about 20 percent of that needed. By way of contrast, the crimping tool number 46110 mentioned above, makes available a continuous force of about 3600 pounds which is indicated by the graph 84 in FIG. 8. This of course results in a very inefficient use of the linear actuator of the tool, while the linear actuator of the present tool may be considerably smaller and yet perform the same crimping task.

An important advantage of the present invention is that the actuating mechanism provides a varying mechanical advantage that closely corresponds to the changing force requirements during the crimping cycle. This permits the use of a smaller sized linear actuator having a smaller power output than would otherwise be necessary. Additionally, by arranging the crimping dies on the axis of the linear actuator, the tool is smaller, well balanced, and generally easier to handle.

I claim:

1. A portable crimping tool for crimping a terminal to a conductor, comprising:

a frame;

a mating pair of crimping dies, one of which is attached to said frame, the other of which is attached to a slide member arranged to reciprocate within said frame for effecting sliding movement of said other die along an axis toward and away from said one die;

a pair of links each having one end pivotally attached to and carried by said slide member;

a first pair of rollers each journaled for rotation at an end of a respective one of said links opposite to said pivotal attachment thereof, said first pair of rollers being on opposite sides of said axis;

a second pair of rollers journaled for rotation in said frame on opposite sides of said axis, said first and second pairs of rollers having mutually parallel axes of rotation; and, a linear actuator attached to said frame and operable to move a wedge along said axis, said wedge arranged to engage said first pair of rollers during extension of said linear actuator such that said first pair of rollers roll on opposite sides of said wedge and are urged into rolling engagement with said second pair of rollers, wherein each of said first pair of rollers moves along an arcuate path about a corresponding one of said second pair of rollers, thereby effecting said sliding movement of said other die toward said one die.

2. The tool according to claim 1, wherein said wedge and said first and second pairs of rollers cooperate to provide a mechanical advantage for a portion of said sliding movement of said other die, and a different mechanical advantage for a different portion thereof, thereby providing a different amount of crimping force for each said portion.

3. The tool according to claim 2, wherein said opposite sides of said wedge are symmetric about said axis, and each of said opposite sides is defined by at least two radii.

4. The tool according to claim 2, wherein said crimping of said terminal onto said conductor requires a specific force for each said portion of said sliding movement, and wherein said mechanical advantage for each said portion provides a crimping force that is selected to be within a predetermined amount in excess of said specific force for each respective said portion.

5. The tool according to claim 4, wherein said predetermined amount is equal to or less than about 20 percent of said specific force.

6. The tool according to claim 1, further comprising resilient members arranged to urge said other die away from said one die.

7. A portable crimping tool for crimping a terminal onto a conductor wherein the crimping of said terminal requires a specific crimping force for each portion of the crimp cycle comprising;

a frame;

a pair of mating crimping dies aligned on an axis, one of which is attached to said frame;

a slide member having the other of said pair of mating dies attached thereto and arranged to move toward and away from said one die along said axis, said movement toward said one die having portions that correspond to respective portions of said each portion of the crimp cycle;

a pair of links, one end of each link being pivotally attached to said sliding member;

a first pair of rollers journaled for rotation at respective said other ends of said links;

a second pair of rollers journaled for rotation in said frame on opposite sides of said axis, said first and second pairs of rollers having mutually parallel axes of rotation;

a wedge movable along said axis toward said one die to an extended position and in an opposite direction to a retracted position, wherein movement of said wedge to said extended position causes said wedge to engage said first pair of rollers so that said first pair of rollers roll on opposite surfaces of said wedge and are urged into rolling engagement with said second pair of rollers such that each of said fist pair of rollers moves about a corresponding one of said second pair of rollers along an arcuate path, whereby a mechanical advantage for each said portion of said sliding movement provides a crimping force that is about equal to said specific force or exceeds said specific force by a predetermined amount for each respective said portion.

8. The tool according to claim 7, wherein said predetermined amount is equal to or less than about 20 percent of said specific force.

9. The tool according to claim 7, including a linear actuator having a movable member, said wedge being attached to and carried by said movable member.

* * * * *